United States Patent [19]

Stella et al.

[11] 4,403,943

[45] Sep. 13, 1983

[54] FLAME SURVEYING MEANS IN BURNER IGNITION

[75] Inventors: Antonio Stella; Giuseppe Canova, both of Legnago, Italy

[73] Assignee: R.B.L. Riello Bruciatori Legnago S.p.A., Legnago, Italy

[21] Appl. No.: 233,761

[22] Filed: Feb. 12, 1981

[30] Foreign Application Priority Data

May 6, 1980 [IT] Italy ..... 21817 A/80

[51] Int. Cl.[3] ..... F23N 5/00

[52] U.S. Cl. ..... 431/31; 431/78

[58] Field of Search ..... 431/31, 78, 71, 24

[56] References Cited

U.S. PATENT DOCUMENTS

| | | | |
|---|---|---|---|
| 4,249,884 | 2/1981 | Cade | 431/31 |
| 4,257,759 | 3/1981 | Miles | 431/31 |
| 4,299,557 | 11/1981 | Brouwer | 431/71 |

*Primary Examiner*—William E. Wayner

*Attorney, Agent, or Firm*—Wenderoth, Lind & Ponack

[57] ABSTRACT

A device for liquid fuel burners includes an electrically controlled valve which allows the feeding of fuel to the burner, the valve being provided with a retaining winding for permanently allowing the flow of fuel when the burner is in operation. The device further includes a combustion chamber pre-purger and a resistor with determines the end of the pre-purging. The device also includes a flame signaller means having a photo-resistance which responds to a preset low light intensity so as to reduce the current flowing through the resistor to such an extent that its heating becomes insufficient to cause the end of the pre-purging. The photo-resistance responds to a high light intensity by activating the retaining winding of the valve and giving the signals necessary for causing the burner to enter its regular operating mode.

7 Claims, 1 Drawing Figure

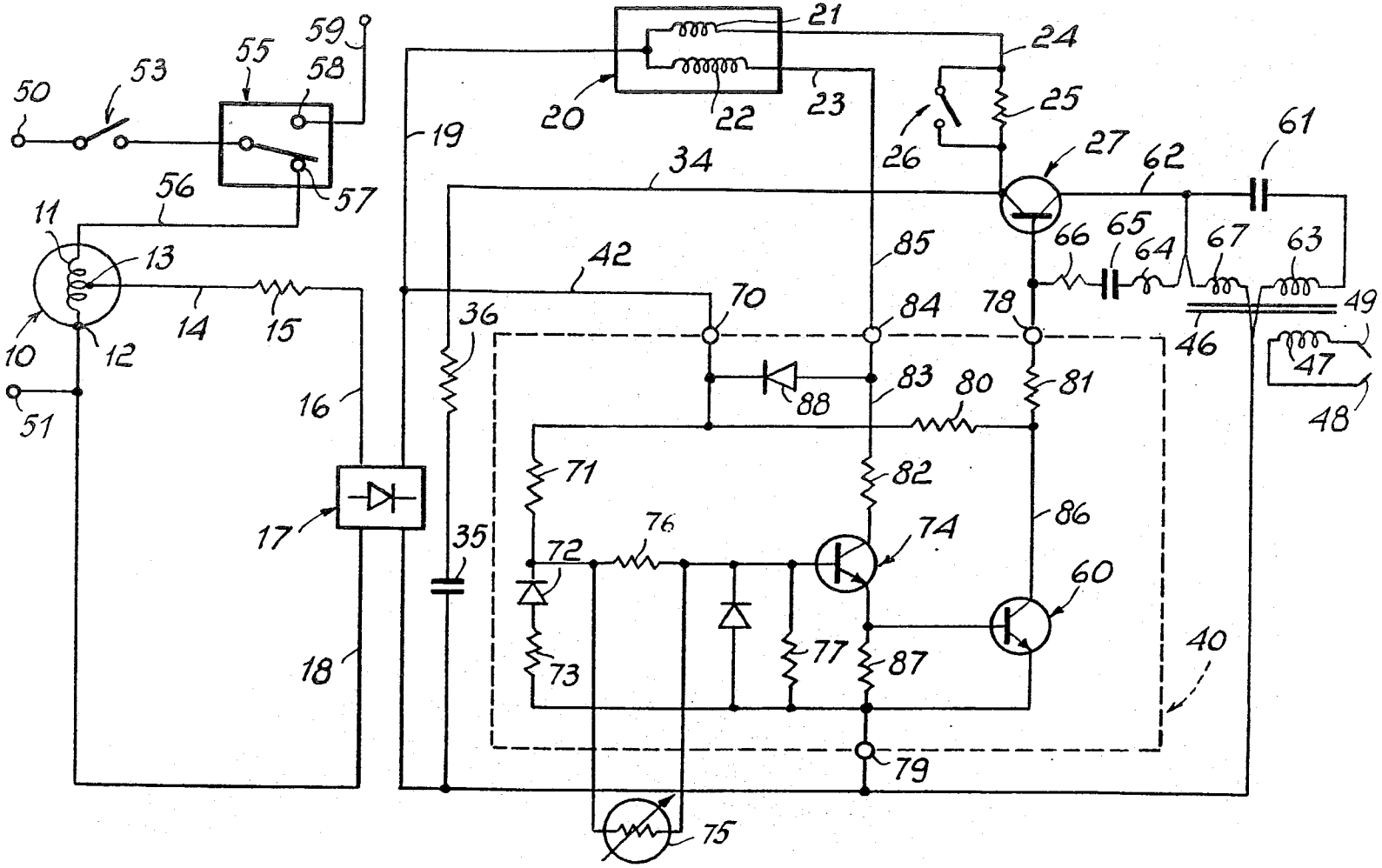
10
11
12
13
14
15
16
17
18
19
20
21
22
23
24
25
26
27
34
35
36
40
42
46
47
48
49
50
51
53
55
56
57
58
59
60
61
62
63
64
65
66
67
70
71
72
73
74
75
76
77
78
79
80
81
82
83
84
85
86
87
88

FLAME SURVEYING MEANS IN BURNER IGNITION

BACKGROUND OF THE INVENTION

The present invention refers to improvements to liquid fuel burner ignition devices and to a control apparatus for said burners which incorporate said improvements.

The invention particularly relates to a burner control apparatus as described in Italian Patent Application Ser. No. 30885 A/75 of the Applicant. Essentially the apparatus comprises a motor actuated by a heat request signal generating means, a fan for feeding air to the burner, a pump for feeding liquid fuel to the burner, a valve means which inhibits the flow of liquid fuel from the pump to the burner in a "closed position" and permits such flow when in an "open position", a means for producing a spark used for igniting the liquid fuel which flows to the burner, which comprises a high frequency ignition transformer having a secondary winding which feeds the ignition electrodes for forming the spark, and a means for feeding the primary winding of the high frequency transformer with a low voltage of a high frequency. The means for feeding the primary winding of the transformer comprises an oscillating circuit which is fed with unidirectional current. The unidirectional current is in turn obtained by rectifying a low voltage and low frequency alternating current, generally having a line frequency, preferably drawn from the motor winding.

Summing up, therefore, a low voltage of a low frequency generally having a line frequency, is rectified to obtain a unidirectional low voltage current, and the rectified current is fed to an oscillating circuit which produces low voltage alternating current of a high frequency with which the primary winding of a transformer is fed; the secondary winding of the transformer furnishes a high voltage of a high frequency to the electrodes for producing the spark used for igniting the fuel.

In ignition devices of this type, in general, it is necessary to provide a flame detection means for determining the suitable operations according to whether the flame forms or does not form in the ignition stage or, after it has been formed, whether it disappears during the operation. If the flame forms, then such a means cause the burner to pass from its ignition mode to its regular stable operating mode, whereby the spark ceases to be formed and a permanent flow of fuel is effected. If the flame does not form, all this does not occur and, through the intervention of other devices, the burner is locked out after a certain preset safety period of time has passed. On the contrary, if the flame forms but goes out during the operation, then the detection means cause the ignition cycle to be repeated, whereby the aforesaid consequences are produced if the flame respectively forms or does not form.

In the cited previous patent of the Applicant, and actually in the invention to be described as well, the presence or the absence of the flame is detected by a photo-sensitive device, e.g. - a photo-cell or a photo-resistance. However, in the known device, and in particular in that of the cited previous patent, the detection of the photo-sensitive device is not fully satisfactory because only its response to a certain light intensity is exploited and not its response to lower light intensities, viz. only one degree of sensitivity is exploited, so that the device can not respond as desired to abnormal operating conditions.

An object of the present invention is an improvement in the flame surveying or detection means and related ignition device controls, which permits the exploitation of two different degrees of sensitivity or levels of a photo-sensitive or photo-revealing device, in different operating modes. More particularly, said different sensitivity levels are such that the sensitivity in the starting phase of the device is higher - i.e. the sensitivity level is lower - than in the operating mode. This behaviour may be defined as a "negative differential sensitivity", which is desirable and is adopted for compliance with regulations and for enabling greater safety. By the expression "photo-sensitive device" is meant herein a configuration of elements or circuit means which comprise a photo-sensitive device (a photo-cell or photo-resistance) which transmits to the other parts of the ignition device the suitable operative signals, as a function of the light intensity of the flame.

It is to be remembered that the operational cycle of the burner ignition device develops starting from an initial pre-purging stage, after which, if the conditions are normal, the ignition spark is caused to form and concurrently the consent is given to enable the flow of the fuel to the combustion chamber, so as to create the conditions for the flame to form. Normally, the ignition of the air-fuel mixture is immediate; if there are abnormal conditions, the ignition attempt may last for a certain time (safety time) which may be e.g. on the order of 5 seconds, whereafter if the flame has not formed, the burner goes into a "block" mode, as is commonly said—viz. a device intervenes which discontinues the electrical feed to the entire apparatus. To produce the electrical contact once again, it is then necessary to manually act on a deblocking push button, after waiting for a certain time which may be about 20 seconds, so that the ignition cycle starts once again from the beginning. If the flame appears before the lock out time is ended, the ignition transformer goes out, the valve which enables the passage of the fluid is controlled so as to be permanently excited, thereby giving a permanent enablement of the outflow of the fuel, and the burner runs regularly until a thermostat stop it. If during the operation, the flame goes out or its luminosity decreases below the photo-sensitivity level, the fuel flow to the combustion chamber ceases and the ignition cycle is repeated from the beginning.

However, additionally, if the photo-resistance sees light during purging, either because something is out of order or because an extraneous light is present in the combustion chamber or elsewhere due to any abnormal condition, the burner must remain in the pre-purging phase without the feeding of the fuel.

The present invention involves a difference of sensitivity of the photo-sensitive device comprising e.g.-a photo-cell or photo-resistance, such that it is more sensitive, as has been said, in the pre-purging mode than in the operating phase. Therefore, even a light intensity which is lower than that which is necessary to maintain the fuel inlet valve actuated and therefore necessary to keep the burner operating, suffices to stop the pre-purging thermal relay, which causes the pre-purging to cease after a preset period of time, and therefore interrupts the counting of the pre-purging time so that the burner remains in this phase until the extraneous light disappears.

SUMMARY OF THE INVENTION

The foresaid and other advantages of the invention are attained by a liquid fuel burner ignition device which comprises an electrically controlled valve which enables the feeding of fuel to the burner and which is provided with a retaining winding for rendering said enabling of the feeding of fuel permanent during the regular operation of the burner; the device further comprises a combustion chamber pre-purging means and a resistor which determines, after a certain period of its heating, the end of the pre-purging, wherein the photo-sensitive device comprises a photo-resistance which responds to a pre-established low light intensity to reduce the current which flows through said resistor to such an extent that its heating becomes insufficient to cause the end of the pre-purging and which responds to a light intensity corresponding to the presence of the flame so as to activate said retaining winding of said valve and to provide the other signals necessary for causing the burner to enter its regular operating mode.

Advantageously, the photo-resistance responds to the different light intensities by producing different intensities of the collector current of a transistor connected thereto.

Conveniently, said transistor has its collector connected to the retaining winding of the valve and is adapted to block, through suitable circuit means, another transistor having its collector connected to the resistor which causes the end of the pre-purging, when the photo resistance senses said pre-established low light intensity.

BRIEF DESCRIPTION OF THE DRAWING AND A DESCRIPTION OF THE PREFERRED EMBODIMENT

A preferred embodiment of the invention will now be described with reference to the attached drawing which is a diagram of the ignition device according to said embodiment.

With reference to the drawing, numeral 10 indicates the ignition device motor having a winding 11 from which a low voltage of a line frequency is drawn off. Said current is drawn off between terminals 12 and 13 and therefore its voltage may be regulated, since said motor acts as an autotransformer. The current passes through conductor 14 and resistive winding, 15, which is the heating winding of the lock out thermal relay, then through conductor 16 and rectifier 17, and returns through conductor 18 to terminal 12 and vice-versa. The winding 11 of the motor is fed from the network through the terminals 50 (phase) and 51 (neutral), the thermostatic means 53, the lock out switch generally indicated at 55, the terminal 57 of the same and the conductor 56. If the lock out switch which is heated by resistive winding 15 (which although is indicated in the drawing as spaced therefrom, is actually wound about the bimetal lamina of relay 55) passes to the lock out condition, viz. opens on terminal 57 and closes on terminal 58, and the current is diverted from the motor to conductor 59 on which another load may be inserted, generally a block condition indicator light (not shown) is inserted.

The rectified current which is output from the rectifier 17 passes through conductor 19 to an electrically controlled valve generally indicated at 20, having an excitation winding 21 and a retaining winding 22. The exitation winding serves to give enable the feeding of fuel to the burner once the pre-purging phase has ended, whereas the retaining winding serves to maintain the valve in a permanently on position if the flame forms within the preset interval of time.

From the excitation winding 21, the current passes through conductor 24 when the ignition has not yet begun, and therefore the pre-purging phase is in effect; the pre-purging phase is the first operative mode of the control device after it has received the heat request signal; consequently, motor 10 has begun to run and the current flows to the heating winding of the pre-purging relay indicated by numeral 25, the pre-purging contact 26 being open. The excitation winding 21 has a very low impedance while that of the heating winding 25 has a much higher value (for example, 1 or 2 Ohm as compared to 500 Ohms). Under these conditions, if there is no flame, transistor 27 operates as a short-circuit. When the pre-purging period has ended, the winding 25 has brought the pre-purging relay to such a temperature that contact 26 closes, the pre-purging ends and the winding resistance 25 is bypassed and the collector current of transistor 27, no longer limited by the winding resistance 25, sharply increases (in practice to about 2 Amperes) bringing the transistor 27 to oscillation conditions. The base and the emitter of transistor 27 are connected to the oscillating circuit to be described later.

The collector of transistor 27 is connected to conductor 34 on which there are preferably inserted a capacitor 35 and a resistor 36 which serve to modulate the amplitude of the rectified current, according to another invention which forms an object of parallel research investigations of the Applicant. Said modulation might be omitted and the rectified current might have a substantially constant amplitude.

The oscillating circuit, connected as has been said to transistor 27, has the function of generating the high frequency voltage, which, suitably stepped up by a transformer having a stepping up coil number ratio, creates the ignition electrical arc. The feed to said oscillating circuit occurs, as has been said, through the excitation winding 21 of a valve 20 and the conductor 24. As has already been said, the winding 21 has a very low impedance while the winding resistance 25 has a much higher value. Assuming that transistor 60, which is connected to the flame detection means and which will be described hereinafter is cut off, which occurs when the photo-sensitive device, which will be described, does not indicate the presence of light; if the pre-purging switch 26 is open, then transistor 27 is saturated and therefore behaves in practice as a short-circuit. On the other hand, when switch 26 closes, current flows therein, and then flows between the collector and emitter of transistor 27, thereby charging capacitor 61 through conductor 62. The charging current also flows through winding 63 (which may comprise 30 turns, for example) and generates a voltage by induction across the winding 64 having a few turns (e.g. -one or two), the generated voltage having such a sign as to cut off transistor 27 due to the reserve polarization applied to the base thereof through reaction capacitor 65 and resistor 66.

Once the transistor 27 has been cut off, capacitor 61 discharges through winding 67 (which may have 20 turns, for example) and said winding 63 in series thereto-it being noted that now the current flows in an opposite direction to that in which it flowed previously - and induces a voltage in winding 64 a voltage having a sign which is opposite to the previous one, which brings transistor 27 back into conduction.

The cycle is repeated at the desired frequency, which in the preferred case is about 20 kHz. At the terminals of the secondary winding 47 of the transformer includes a ferrite core 46, a sinusoidal wave is present having the same frequency but a very high voltage (e.g. about 10 kV) which produces an arc between the ignition electrodes 48 and 49.

The flame detection circuit which will now be described is preferably—in the preferred constructive embodiment—embodied in an independent panel or block, which is indicated in the drawing in broken lines and designated as a whole by numeral 40. At the terminal 70 of said panel, connected by conductor 42 to the output of rectifier 17, a voltage is present which is applied through resistor 71 to Zener diode 72 having resistor 73 in series thereto. In practical cases, said voltage is stabilized at a value which may be, indicatively, about 9.5 volts.

A fraction of said voltage is applied to the base of transistor 74 through the divider constituted by the parallel combination of a photo-resistance 75 and a resistor 76 (resistor 76 has only safety purposes and does not substantially affect the operation) and the resistor 77. The value of the photo-resistance determines the level of this voltage. If the photo-resistance 75—or other photo-sensitive device—which is located within the burner chamber, does not see light, its resistance is high and the aforesaid voltage is therefore small, on the order of tenths of Volts, e.g. 0.4 volt. When the light of the flame impinges on said photo-resistance, it reduces its value, and the voltage applied to the base of transistor 74 rises until it reaches a higher value, e.g. about 1.2 Volt. At this stage transistor 74 begins to conduct and when its emitter current reaches a value of about 0.6 mA, transistor 60, previously mentioned, which was in the cut-off state, switches to the conductive state. Said transistor 60 acts as a static switch for controlling the oscillator through conductor 86 and terminal 78, and when it goes into conduction it generates, via terminal 79 of block 40, the current which biases transistor 27 through resistances 80 and 81. A NTC resistance 73 compensates for the variations of the base-emitter voltages of transistors 74 and 60 with respect the temperature, so as to maintain constant the critical control value of the photo-sensitive device.

Transistor 74, besides acting—as has been said—as a control for transistor 60, also determines the retaining operation of valve 20. Actually, after said valve has been excited through winding 21, it is maintained excited by the current which flows in the retaining winding 22 through resistor 82 and the collector of transistor 74, viz. through conductor 83, terminal 84 of block 40 and terminal 85. The minimum value of said current is about 7–8 mA and depends upon the state of saturation of transistor 74 and therefore (all other conditions being equal) on the intensity of the light which impinges on the photosensitive device's on resistance. If the light decreases in such a way that the current decreases below said level, the valve ceases to be excited and the flow of fuel is interrupted and the flame goes out. Obviously the photocell or other photosensitive devices will now see no more light and therefore the current in the transistor further decreases until transistor 60 becomes cut off. The device then once more carries out the complete ignition cycle. The operation of the previously described circuit occurs as follows.

When thermostat 53 is closed because of a heat request, the motor starts to run, and actuates the pump and the fan and a voltage is provided to the apparatus. If as normally occurs, the photo-cell or photo-resistance 75 does not see any light, transistors 74 and 60 are cut off and transistor 27 is saturated. The collector current of this latter transistor, flowing through the heating winding 25 of the pre-purging relay, causes a bimetal lamina which is a part thereof to bend, and this lamina after a certain time (13–14 sec.) closes contact 26.

The total current which flows during this phase through the block heating winding 15 is, however, not sufficient to bend the corresponding bimetal element of relay 55 and therefore has practically no effect thereon.

If, during the pre-purging, the photo-resistance 75 sees light, even a weak light but sufficient to render transistor 74 as conductive as suffices to saturate transistor 60, Then this latter transistor conducts the current from terminal 78 to ground (terminal 79); transistor 27, the base of which is no longer fed, in turn becomes cut off, and thus, its collector current, which flows through winding 25 and branch 34, is no longer sufficient alone to heat the pre-purging bimetal element, whereby contact 26 does not close anymore. This situation remains as long as the photo-cell 75 continues to see light.

When at the end of the pre-purging, contact 26 closes, it by-passes the heating winding 25 which ceases to act. The collector current of 27, no longer limited by the winding resistance 25 (500 Ohm) sharply increases (to 2 A) bringing transistor 27 into a oscillating condition, viz. into the condition wherein the oscillating circuit operates as described hereinbefore.

Said current also flows through winding 21 of the valve and is sufficient to excite it. The sharp increase in current also affects the low feed current of the motor; the alternating current required now by the circuit is sufficient to heat the bimetal of the lock out thermal relay 55 through resistive winding 15. Under normal conditions, the fuel becomes immediately ignited; photo-resistance 75 sees the light and through transistors 74 and 60 cuts off oscillator transistor 27, eliminating the current running through the excitation branch; and concurrently, the ignition spark ceases and the heating through the winding 15 of the lock out relay 55 ceases. The current through winding 21 of the valve decreases below the limit which suffices for the excitation, but concurrently there is the intervention of the retaining winding 22 through which a current passes; said current also flows through conductor 85, terminal 84 of block 40, resistor 82 and transistor 74—connected at 79, through resistor 87, to ground. The transistor 74 is thus rendered conductive by the light of the flame which lights the photo-resistance 75.

Resistor 76 has a very high value with respect to the light resistance of photo-resistance 75 and therefore does not affect the operation.

When the flame appears, the value of the photo-resistance decreases but it does not decrease instantaneously; a certain time is required for it to reach the light resistance value, and this time depends on many factors. The most important are: the composition of the photo-resistive material, the time during which it has remained in the dark, and the intensity of the flame light.

As has been said, the transformer goes out when the collector current of 27 reaches about 0.6 mA, while for retaining valve 20, a higher current (7–8 mA) is required. On the other hand, when the transformer goes out, the excitation action through winding 21 also ceases, and therefore it would seem at first sight impossible for the valve to remain excited. However, this occurs, for the following reasons.

Windings 21 and 22 of valve 20 are wound one on the other and are therefore magnetically coupled. During the operation of the oscillator, the current which flows through 21 has a modulation at 100 Hz due to the low filtering action of capacitor 35. A diode 88 is in parallel to the retaining winding 21. The moment in which the oscillator is cut off, there is a sharp decrease of current and the strong flux variation induces a voltage in winding 22 of a suitable sign (due to the winding direction of 21 and 22) which produces a current through 22 and the diode 88, having a high value (70÷80 mA). This current decreases exponentially and requires about 20 ms. to decrease below 10 mA.

Meanwhile, the photo-resistance has a decreasing value and after the aforesaid time must be able to furnish to the base of transistor 74 the control required to cause the current necessary for retaining the valve to flow through the collection of 74. It is therefore necessary to adopt a photo-resistance having a high darkness-light response speed.

When the photo-resistance, lighted by the flame, intervenes to lock out the initial transformer, the heating of the lock out relay consequently ceases. The heating of the pre-purging relay has already ceased when contact 26 had closed at the end of the pre-purging period. Therefore, the pre-purging relay, after the end of a certain time due to its thermal inertia (about 20÷30 sec.) goes back to the rest position, opening contact 26 once again.

The burner is now operating regularly and therefore transistor 27 is locked out, as seen, and there is no heating in winding 25. Therefore, the opening of the contact has no substantial effect on the operation. If now the flame disappears or its luminosity decreases below the sensitivity value of the photo-resistance operation, the apparatus repeats the ignition cycle from the beginning; if, on the other hand the flame goes out, or its luminosity decreases (before contact 27 has reopened) an immediate ignition attempt occurs, without pre-purging.

The two values of the collector current of 74 which produce respectively the actuation of the oscillator of the ignition transformer (0.6 mA) and the retaining of the valve (7÷8 mA) are chosen at two different levels to cause the light required by the photo-resistance to maintain the valve in an excited condition (operating sensitivity) to be greater than that which is sufficient to cause the interdiction of 27 and therefore the stopping of the pre-purging thermal relay (starting sensitivity) during the starting phase. Therefore, as has been said, the starting sensitivity is higher than the sensitivity during operation (i.e. - a negative differential sensitivity).

We claim:

1. An ignition and flame surveying device for a liquid fuel burner comprising an electrically controlled valve which enables the feeding of fuel to said burner and which is provided with a retaining winding for rendering said feeding of fuel permanent during regular burner operation, and which further comprises a combustion chamber pre-purging means and a resistor which determines, after a preselected time period of its heating, the end of a pre-purging cycle, said device further comprising a flame detection photo-sensitive means comprising a photo-resistance which responds to a preset low light intensity to reduce the current which flows through said resistor to such an extent that its heating becomes insufficient to cause the end of said pre-purging cycle, while it responds to a light intensity corresponding to the presence of a flame in said combustion chamber to activate said retaining winding of said valve and to provide other signals necessary for causing said burner to pass to its regular operation mode.

2. A device according to claim 1, wherein an output of said photo-resistance corresponds to different light intensities by producing different intensities of a collector current of a transistor connected thereto.

3. A device according to claim 2, wherein said transistor has its collector connected to said retaining winding of said valve and is adapted to cut off, through suitable circuit means, another transistor having its collector connected to said resistor, wherein said pre-purging is ended when said photo-resistance senses said preset low light intensity.

4. A device according to any one of the preceding claims, further comprising a flame detection means provided with at least two sensitivity levels, wherein a higher of said two sensitivity levels acts on the activation and deactivation of an ignition transformer, while a lower of said two sensitivity levels acts to control said retaining winding of said valve which is used for controlling an intake of fuel into said combustion chamber.

5. A device according to claim 4, wherein the control of said ignition transformer and the control of said valve takes place through preset current intensity levels.

6. A device according to claim 5, wherein the value of said current intensity corresponding to said higher sensitivity level is on the order of tenths of milliamperes while the value of the current intensity corresponding to said lower sensitivity level is on the order of milliamperes.

7. A device according to claim 5, wherein the current which defines by its intensity level the conditions for the control of said transformer and said fuel valve, flows through control circuits of both said transformer and said fuel valve, said control circuits being connected in series with respect to said current.

* * * * *